US010550576B2

(12) United States Patent
Morrison

(10) Patent No.: US 10,550,576 B2
(45) Date of Patent: Feb. 4, 2020

(54) WALL, ENTRYWAY, OR COLUMN HANDRAIL WITH SIDE TO SIDE BRACING

(71) Applicant: Bobby Stephen Morrison, Jackson, TN (US)

(72) Inventor: Bobby Stephen Morrison, Jackson, TN (US)

( * ) Notice: Subject to any disclaimer, the term of this patent is extended or adjusted under 35 U.S.C. 154(b) by 531 days.

(21) Appl. No.: 15/436,997

(22) Filed: Feb. 20, 2017

(65) Prior Publication Data

US 2017/0241143 A1 Aug. 24, 2017

Related U.S. Application Data

(60) Provisional application No. 62/389,351, filed on Feb. 24, 2016.

(51) Int. Cl.
*E04F 11/18* (2006.01)

(52) U.S. Cl.
CPC ... *E04F 11/1804* (2013.01); *E04F 2011/1887* (2013.01); *E04F 2011/1889* (2013.01); *E04F 2011/1897* (2013.01)

(58) Field of Classification Search
CPC ..... E04F 2011/1887; E04F 2011/1889; E04F 2011/1897; E04F 11/00; E04F 11/18; E04F 11/1802; E04F 11/1804; E04F 11/1863; E04F 11/1868; E04F 2011/1868; A47K 17/022; A47K 3/003
USPC ..... 256/65.16
See application file for complete search history.

(56) References Cited

U.S. PATENT DOCUMENTS

| | | | | |
|---|---|---|---|---|
| 3,398,410 | A * | 8/1968 | Sparling | A47K 17/022 4/254 |
| 3,414,909 | A * | 12/1968 | Provi | A47K 3/003 4/577.1 |
| 3,448,468 | A * | 6/1969 | Murcott | A47K 3/003 4/577.1 |
| 3,568,220 | A * | 3/1971 | Dees | A47K 3/003 4/576.1 |
| 8,661,740 | B2 * | 3/2014 | Lin | E06B 11/085 248/292.13 |
| 9,133,624 | B2 * | 9/2015 | Danziger | E04F 11/1863 |
| 10,066,398 | B1 * | 9/2018 | Guerrero | E04F 11/1863 |
| 2014/0374681 | A1 * | 12/2014 | Brindamour | E04F 11/1863 256/65.16 |

FOREIGN PATENT DOCUMENTS

| | | | | |
|---|---|---|---|---|
| DE | 19912516 | A1 * | 9/2000 | A47K 17/022 |

* cited by examiner

*Primary Examiner* — Jonathan P Masinick
(74) *Attorney, Agent, or Firm* — Patterson Intellectual Property Law, P.C.; William E. Sekyi

(57) ABSTRACT

A handrail mountable on a generally vertical building mounting surface adjacent the frame of a building doorway to support elderly, infirm or disabled enter and exit the doorway. Side braces attachable to the door frame and, optionally, a vertical wall mounting surface provide additional lateral strength to the railing and reduce stress on mounting surfaces.

10 Claims, 5 Drawing Sheets

WALL, ENTRYWAY, OR COLUMN HANDRAIL WITH SIDE TO SIDE BRACING

CROSS-REFERENCES TO RELATED APPLICATIONS

This application claims benefit of the following patent application(s) which is/are hereby incorporated by reference: 62/389,351 filed Feb. 24, 2016.

FIELD OF THE INVENTION

The present invention relates generally to handrails to support the elderly, infirm and disabled. More particularly, this invention pertains to wall-mounted handrails with side to side bracing.

BACKGROUND OF THE INVENTION

Doorways in buildings can be used as access points between areas having different floor levels. Where the difference in height between floor levels is too large for people to conveniently move through the doorway between the different floor levels, buildings may often include stairs or escalators with banisters to assist and provide support to individuals. There are occasions, however, when the floor height difference is not great warranting only a few steps on one or both sides of the doorway. At times, these doorways are created as a modification to a building such as an older house, or else the flooring on and around the stairs are insufficiently strong, or because space constraints do not allow placement of a full floor-supported banister. At times, elderly, infirm or disabled individuals may find passage through such a doorway difficult or infeasible without some kind of support.

Mounting a cantilevered handrail on a vertical building structure such as a wall without secondary vertical support along the length of the railing through, for example, a baluster or other vertical member attached to the floor or stair may provide insufficient support to withstand the forces that a large individual might generate. These forces can include forces lateral to the cantilevered handrail's mounting surface—both vertical and horizontal (side-to-side), forces perpendicular (towards or away from) the mounting surface, or torsional forces that twist the railing in some direction. Excessive forces can generate stresses on the mounting surface that crush the material of the building surface or pull the handrail off the building surface. What is needed, then, is a handrail that be mounted at a location conveniently adjacent to the doorway and distribute these forces over the mounting surface of the wall so that the handrail remains resiliently fixed to the building to provide lasting support to users.

BRIEF SUMMARY OF THE INVENTION

According to one embodiment, the present invention provides a handrail includng a rail having a first distal portion proximate to a first end, a second distal portion proximate to a second end, and a middle portion between the first and second distal portions. The first and second ends are attached to a first surface of a faceplate and the first distal portion extends perpendicularly from the first surface. The handrail can also include a cross brace spaced apart from the faceplate that extends between the first and second distal portions. A first side brace can be attached to the cross brace and extends from the cross brace across a plane formed by the first surface to a first brace mounting end.

Optionally, the handrail of this embodiment can further include a second side brace attached to the cross brace that extends towards the plane formed by the first surface to a second side brace mounting end. The handrail can have a tubular cross section and can, as a further option, be formed from a metal, wood, or a polymer. Moreover, in some embodiments the faceplate can be rectangular.

In these embodiments, the second distal portion can extend from the first surface perpendicularly. According to yet another option, a top surface of the first distal portion and the bottom surface of the second distal portion can define a handrail height and an outer surface of the middle portion and the first surface can define a handrail length perpendicular to the handrail height, and the handrail height can be less than about 42 inches. Optionally, also, the handrail length can be less than about 42 inches

DETAILED DESCRIPTION OF THE INVENTION

Figure 1:
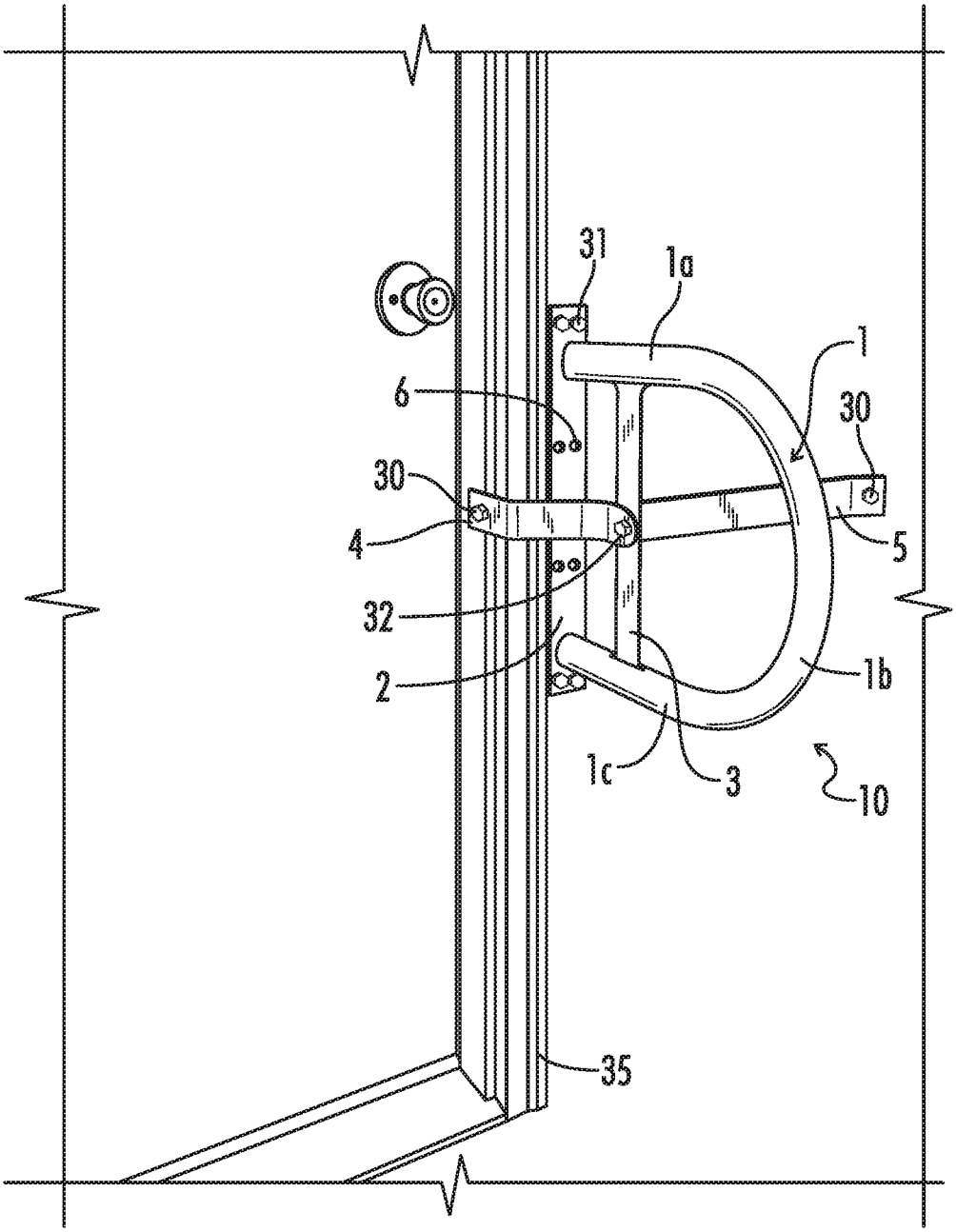
FIG. 1 is a perspective view of a handrail according to one embodiment of the present invention.

FIG. 1 is a perspective view that depicts handrail 10 according to one embodiment of the invention. In FIG. 1, handrail 10 is shown mounted to a building wall adjacent to a door frame and can advantageously be located to provide additional support to the elderly, infirm or disabled entering or leaving through the doorway. Handrail 10 can be particularly useful where the doorway is situated between floors at different levels warranting the placement of a short flight of stairs on at least one side of the doorway to facilitate access through the doorway. Handrail 10 can be further beneficial where there is no wall or other structure, such as a banister, that is within reach to provide support to a person entering or leaving through the doorway. For various reasons, such as space limitations, providing clearer unobstructed access to the doorway and stairs and unsound floor or stair structure, a floor-mounted conventional banister may be unsuitable. In such cases, handrail 10, when properly mounted to a generally vertical building structure, such as a wall or column, at a convenient height immediately adjacent the doorframe, can provide sufficient support for even a large elderly, infirm, or disabled person without unduly obstructing access to the entryway. When so attached to a mounting surface of a building, handrail 10 can provide enhanced support and resist forces that may be applied by a user laterally to the mounting surface (i.e. horizontally or vertically), perpendicularly to the mounting surface (i.e. towards or away from the mounting surface) as well as torsionally (with a twisting force).

Handrail 10 includes rail 1, which has a first end and a lower second end that are rigidly attached to faceplate or mounting plate 2. Rail 1 has a first distal portion 1*a* near to, and extending from, the first end. Rail 1 also includes a second distal portion 1*c* near to, and extending from the second end. As shown in FIG. 1, middle portion 1*b* joins first and second distal portions 1*a*, 1*c* and can include curved or bent portions in any suitable or desirable design, such as a continuous arc or a series of linear sections angled to one another. While first distal portion 1*a* preferably extends perpendicularly from faceplate 2 to provide a convenient support for a user wishing to hold onto handrail 10 for support, second distal portion 1*c* may not be used for such purpose so frequently and accordingly may advantageously extend from faceplate 2 in a non-perpendicular, oblique direction. However, as will be understood, first distal portion 1*a* may also extend obliquely as most suited for particular applications without deviating from the scope and intent of the present invention.

Faceplate 2 can be a generally rectangular plate that supports rail 1 and provides a structure to attach rail 1 conveniently and securely to a building. Accordingly, faceplate 2 can include mounting holes 6 through which fasteners, such as faceplate mounting screws, bolts, or anchors 31 affix mounting plate 2 to a building. Those skilled in the art will understand that faceplate 2 can be affixed to a building by alternative methods, such as by applying adhesives between the faceplate and the building structure, by welding, by soldering or partially embedding faceplate 2 into a building structure. Faceplate 2 should preferably be made of such material and of appropriate dimensions to offer sufficient structural rigidity to withstand the perpendicular, lateral and torsional loads that may be applied to handrail 10. Faceplate 2 should also preferably distribute the concentrated loads applied by rail 1 to faceplate 2 over the contact area between the faceplate 2 and the mounted surface of the building to reduce the magnitude of pressure peaks and the likelihood of structural failure of the mounted surface.

Figure 2C:
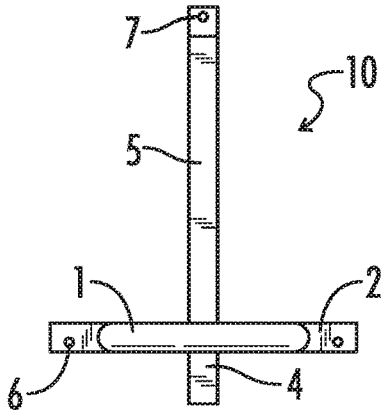
FIG. 2C is a top view of the handrail of FIG. 2A.
Figure 2B:
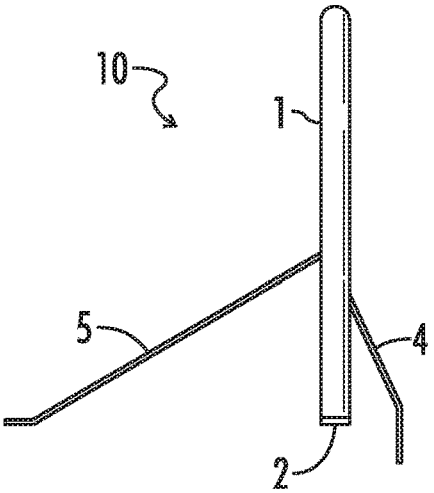
FIG. 2B is a side view of the handrail of FIG. 2A.
Figure 2A:
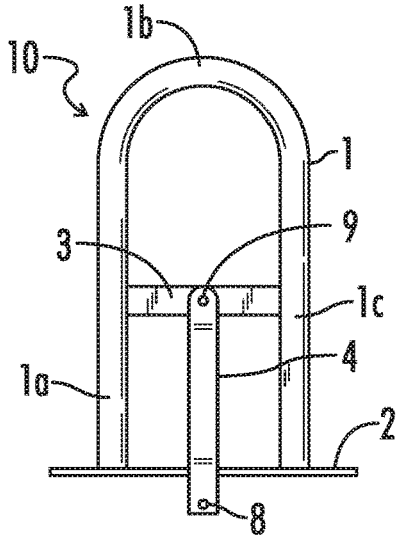
FIG. 2A is a front view of the handrail of FIG. 1.

In view of structural, dimensional and design requirements, faceplate 2 will have a thickness as shown, for example, in FIGS. 1 and 2A, and while main forward-facing (or first) surface of faceplate 2 to which rail 1 is attached and the rear-facing mounting (or second) surface are shown as rectangular, the present invention should not be understood to be limited to this shape. However, it will be understood that faceplate 2 can be made from a number of suitable materials, such as metal, wood, polymeric material and composite materials of varying strengths and flexural rigidity. Accordingly, the thickness of faceplate 2 may be different for different materials and depending on the expected loading expected on handrail 10 and manufacturing convenience. The number, position and size of mounting holes 6, if used to attach faceplate 2 to a mounting surface, can also depend on the faceplate shape and material as well as the material of the building mounting surface and fasteners 31 used to mount handrail 10.

Handrail 10 can also include cross brace 3 that extends between first distal portion 1*a* and second distal portion 1*c*, but at a perpendicular distance from the plane formed by the surface of faceplate 2. In addition to strengthening handrail 10, cross brace 3 can also provide an attachment point for first side brace 4 and second side brace 5. In the embodiment of FIG. 1, first side brace 4 and second side brace 5 are attached to cross brace 3 by fastener 32. Fastener 32 can be a nut and bolt, a rivet or other appropriate fastener known in the art. Although first side brace 4 and second side brace 5 can be attached to cross brace 3 by fastener 32, other methods of attachment may be other suitable methods, such as welding or brazing that can provide a sufficiently strong and rigid attachment of the side braces 4, 5 to cross brace 3. Fasteners can advantageously be used where the side braces 4, 5 are delivered for mounting disassembled from the rest of the handrail 10 permitting adjustment of the precise placement and positioning of side braces at the time of mounting. However, it will also be understood that one or more of first side brace 4 and second side brace 5 can also be formed integrally with cross brace 3 at the time of manufacture so that no subsequent assembly is required and the quality and strength of the side brace and cross brace joint can be controlled in manufacture.

As shown in FIG. 1, first side brace 4 extends from cross brace 3 across the plane formed by faceplate 2 to a point on the door frame that is also laterally spaced from the cross brace. First side brace 4 thus extends in an oblique direction from rail 1 and side brace 4 and provides both lateral and additional perpendicular support for rail 1. The end of first side brace 4 furthest from cross brace 3 can be securely attached to the door frame by fastener 30, which can be a screw, nail, nut, bolt and the like, secured through a mounting hold in first side brace 4 to the door frame. Second side brace 5 similarly extends laterally from cross brace 3 and towards the plane formed by faceplate 2 so that the distal end of second side brace is spaced apart from cross brace 3 and rail 1. The end of second side brace 5 furthest from cross brace 3 includes a mounting hole through which another fastener 30 can secure the end of second side brace 5 to a portion of the building structure, such as a wall. The portion of the building structure on which side brace 5 is mounted can be an extension of the same mounting surface as faceplate 2 is mounted. However, it will be understood that the surface on which second side brace 5 is mounted can be raised or recessed compared to the mounting surface of the faceplate 2. Accordingly, second side brace 5 also extends obliquely away from side brace 3 and provides both lateral and perpendicular support for rail 1.

FIG. 2A is a front view of an embodiment of a handrail according to the present invention. Rail 1 is connected to faceplate 2, with first and second distal portions 1*a*, 1*c* extending perpendicularly from the faceplate's main, front-facing surface. The handrail length—the distance from the first faceplate surface to the outermost surface of the middle portion 1*b* of rail 1—can be up to about 42 inches. Although the second distal portion 1*c* is shown extending perpendicularly from the front-facing surface of faceplate 2, it should be understood that second distal portion 1*c* can extend from faceplate 2 at an angle or may even be curved. Cross brace 3 extends between first and second distal portions 1*a*, 1*c*, respectively, of rail 1, which are spaced apart. The length of cross brace 3 will depend on the distance between first distal portion 1*a* and second distal portion lc at the point of attachment to cross brace 3 governed by the specific design of rail 1.

In some applications, due to space, aesthetic or structural constraints, for example, a rail 1 with an extended middle portion 1*b* and large distance between first distal portion la and second distal portion 1*c* may be undesirable or inappropriate. However, a short distance between the first and second ends of rail 1 that attach to faceplate 2 may place unduly large stress at the attachment points to the faceplate when a user applies a downward lateral force near the middle portion of rail 1. Furthermore, in such situations, a short faceplate 2 may place unduly high stress on the mounting surface of the building structure and fasteners 31 leading to premature failure. To account for these competing constraints, faceplate 2 can be lengthened and second distal portion 1*c* curved or angled so that the second end of rail 1 attaches to the face plate far apart from the first end while also permitting the distance between the first distal portion and the second distal portion to narrow as it approaches the middle portion. The broad spacing between the attachment points of the first and second ends, and the longer length of faceplate 2, can help to reduce stress in the faceplate at the rail attachment points and also reduce stress in the mounting surface of the building structure.

In FIG. 2A, first side brace 4 is shown with mounting hole 9 at one end that also passes through cross brace 3. Fastener 32 can be used to securely attach first side brace 4 to cross brace 3. The opposite end of first side brace 4 includes mounting hole 8 through which fastener 30 can securely attach side brace 4 to a door frame. FIG. 2B is a side view of the handrail 10 of FIG. 2A. showing second side brace 5 and first side brace 4 extending obliquely from cross brace 3 (not shown). It will be understood that side brace 5 can similarly include a mounting hole and be fastened to cross brace 3 by fastener 32. As shown, second cross brace 5 extends laterally away from rail 1 and towards the plane formed or defined by faceplate 2. It will be understood that in some applications where the mounting surface for the second side brace 5 is an extension of the same surface on which faceplate 2 is mounted, second side brace 5 will extend to approach that plane. However, where the mounting surface for the second side brace 5 is recessed or raised compared to the mounting surface for faceplate 2, second side brace 5 will extend to a point beyond or short of the faceplate mounting surface, respectively. First side brace 4, on the other hand will in most circumstances extend to a point beyond the faceplate's mounting surface so that its distal end can attached to an interior point on a door frame. In any event, the oblique lateral extension of first and second side braces 4, 5 permit them to provide lateral support to rail 1 in a generally horizontal direction when handrail 10 is mounted.

Figure 2D:
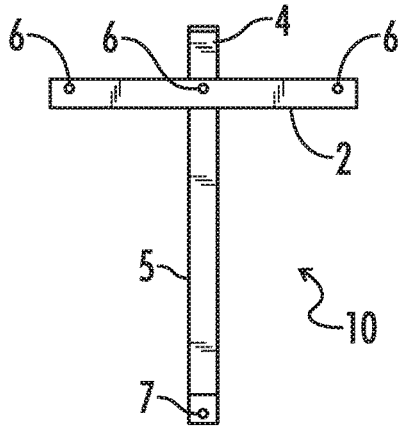
FIG. 2D is a bottom view of the handrail of FIG. 2A

FIG. 2C is a top view of handrail 10 showing rail 1 on faceplate 2. In this view, the front-facing main surface of faceplate 2 is partly visible, although its central portions are obscured by rail 1. Faceplate 2 includes mounting holes 6. First side brace 4 and second side brace 5 extend laterally from rail 1 and cross brace 3 (not shown). In this top view, mounting hole 7 of second side brace 5 is visible. FIG. 2D is a bottom view of handrail 10. Rail 1 is obscured, but the rear-facing main surface of faceplate 2 is fully visible, as are mounting holes 6. Similar to FIG. 2C, first and second side braces 4, 5 are shown extending laterally from rail 1 and cross brace 3 which are hidden from view. The distal mounting end of second side brace 5 includes mounting hole 7.

Figure 3B:
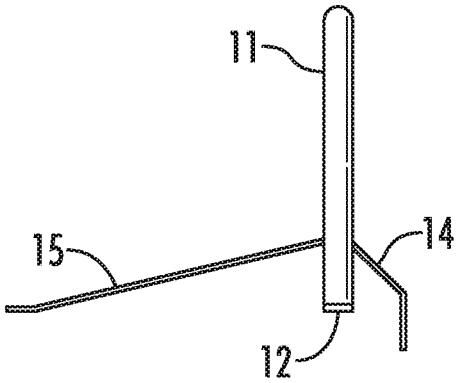
FIG. 3B is a side view of the handrail of FIG. 3A.
Figure 3A:
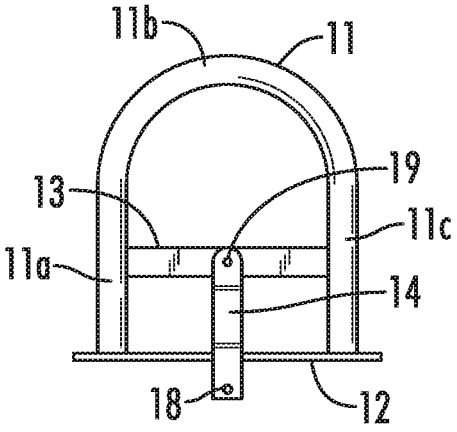
FIG. 3A is a front view of an alternative embodiment of a handrail according to the present invention.

FIGS. 3A and 3B show an alternative embodiment of a handrail according to the present invention with a rail 11 having a greater distance between first and second distal portions 11*a*, 11*c*, respectively and having a long middle portion 11*b* in comparison to the distal portions 11*a*, 11*c*. When mounted on a generally vertical building mounting surface the distance between the top surface of the first distal portion 11*a* and the lowest surface of the second distal portion 11*c* defines a handrail height which can be up to about 42 inches. Cross brace 13 can extend between first and second distal portion 11*a* and 11*c*. Rail 11 is attached to a first surface of faceplate 12. First side brace 14 and second side brace 15 can be attached to cross brace 13 using a fastener passing through mounting hole 19 that extends through first side brace 14, cross brace 13 and also second side brace 15. First side brace 14 can extend obliquely and laterally from cross brace 13 to a mounting point on a door frame where it can be attached via a fastener passing through mounting hole 18. Similarly, second side brace 15 can extend obliquely and laterally to a mounting point on a building mounting surface.

Figure 4B:
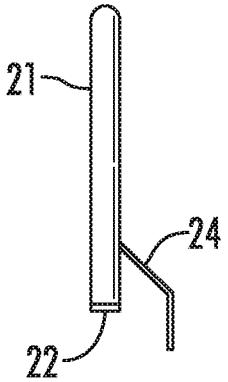
FIG. 4B is a side view of the handrail of FIG. 4A.
Figure 4A:
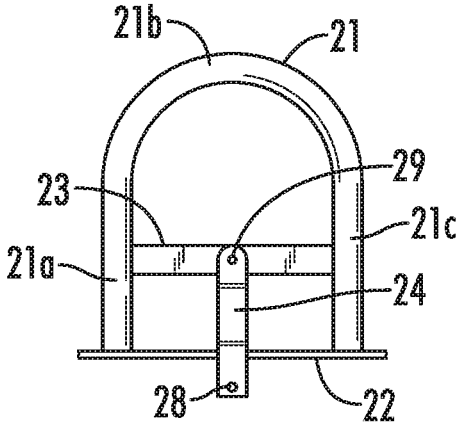
FIG. 4A is a front view of an alternative embodiment of a handrail according to the present invention with a single side brace.

FIGS. 4A and 4B show an alternative embodiment of a handrail according to the present invention with a rail 21 having a greater distance between first and second distal portions 21*a*, 21*c*, respectively and having a long middle portion 21*b* in comparison to the distal portions 21*a*, 21*c*. When mounted on a generally vertical building mounting surface the distance between the top surface of the first distal portion 21*a* and the lowest surface of the second distal portion 21*c* defines a handrail height which can be up to about 42 inches. Cross brace 23 can extend between first and second distal portion 21*a* and 21*c*. Rail 21 is attached to a first surface of faceplate 22. Unlike the embodiment shown in FIG. 3B, this embodiment uses only a first side brace 24. First side brace 24 can be attached to cross brace 23 using a fastener passing through mounting hole 29 that extends through first side brace 24, cross brace 23 and also second side brace 25. First side brace 24 can extend obliquely and laterally from cross brace 23 to a mounting point on a door frame where it can be attached via a fastener passing through mounting hole 28.

Figure 5:
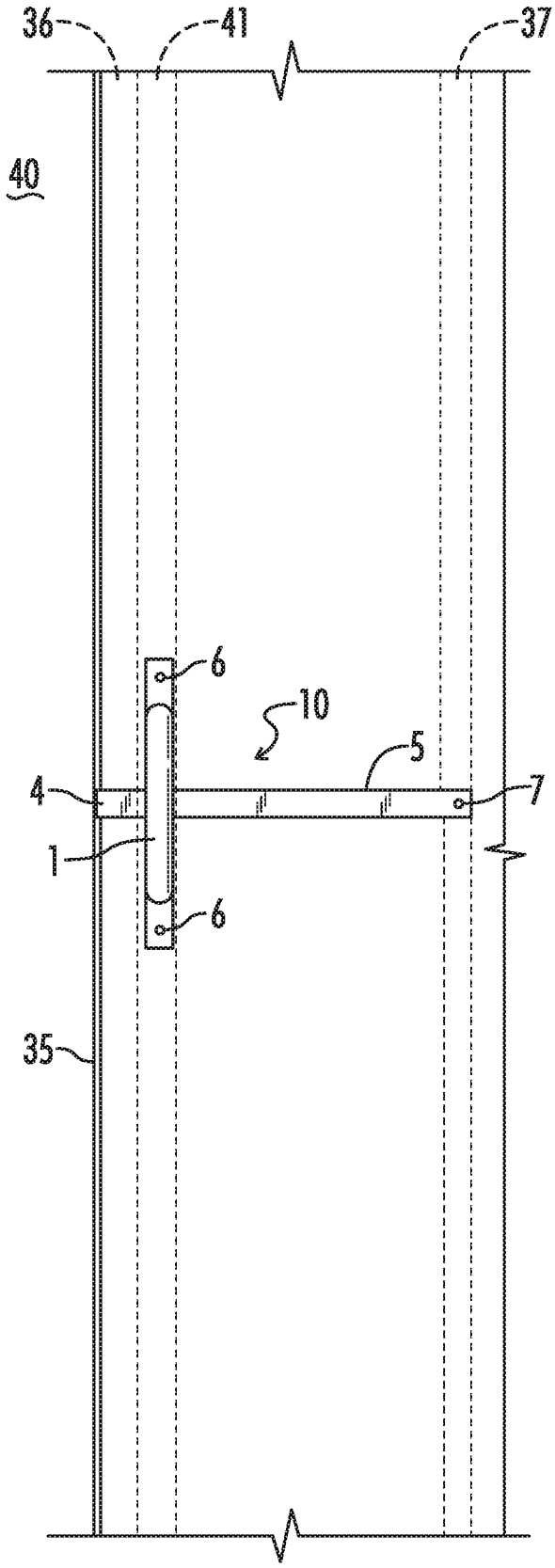
FIG. 5 is a top view of an embodiment of a handrail according to the present invention positioned on a wall with respect to an exemplary door frame and underlying wall studs.
Figure 6:
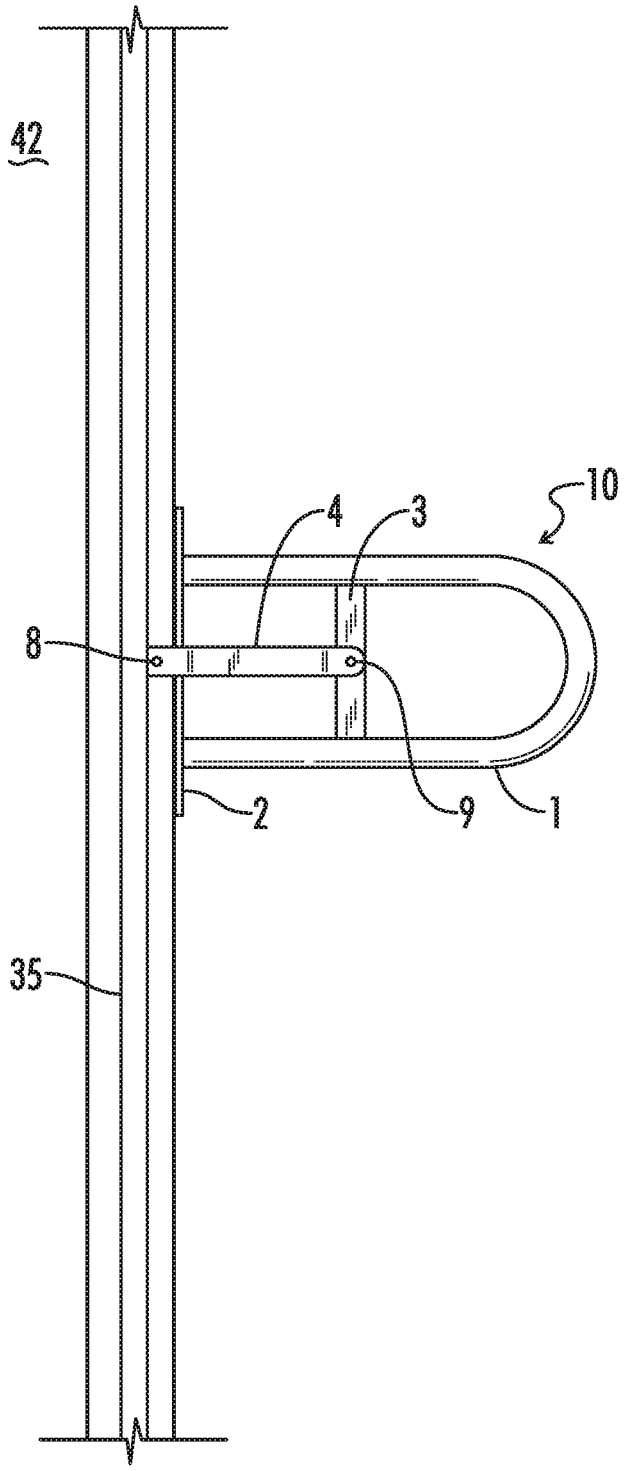
FIG. 6 is a front view of an embodiment of a handrail according to the present invention positioned on a wall with respect to a door frame.

In FIG. 5, handrail 10 of FIG. 1 is shown positioned on a building wall adjacent a door frame 35 and showing the position of the handrail with respect to vertical timber members, or studs, commonly used in some building construction methods. Handrail is preferably located close by door opening 40 in a manner consistent with prevailing laws and regulations and building codes and in a position conveniently accessible to support users passing through the door opening. In commonly used building construction methods, door frame 35 is fastened to doorway stud 36. Stud 36 is immediately adjacent to second doorway stud 41. First wall stud 37 may be separated from the doorway studs by some distance. The studs are generally covered by wall paneling, such as plasterboard or drywall and the doorway may be ornamented with decorative molding around doorframe 35. According to one method, handrail 10 can be mounted on a wall over second doorway stud 41 so that mounting hole 7 of second side brace 5 is over first wall stud 37. Fasteners 30 and 31 can attach second side brace 5 and faceplate 2 by penetrating through holes 7 and 6, through wall paneling and into studs 37 and 41, respectively. FIG. 6 is a front view of handrail 10 shown positioned on a building vertical surface, similar to FIG. 5, but shown from a viewpoint inside doorway 40 that separates one side of the building 42 at one level from a lower side where handrail 10 is mounted. Rail 1 is attached to faceplate 2 and cross brace 3 extends between first and second distal portions of rail 1. Side brace 4 can be attached to cross brace 3 via mounting hole 9 that extends through one end of side brace 4 and cross brace 3 using a fastener. A fastener can attach the other end of first side brace 4 through mounting hole 8 into door frame 35.

The components of the handrail according to the present invention can be formed from various suitable materials known in the art, such as various metals, polymers, wood, ceramic and composites of these materials. To reduce weight and expense components such as the rail can be tubular, hollowed or profiled in various cross sectional shapes to maintain rigidity.

Thus, although there have been described particular embodiments of the present invention of a new and useful it is not intended that such references be construed as limitations upon the scope of this invention except as set forth in the following claims.

What is claimed is:

1. A handrail comprising:

a rail having a first distal portion proximate to a first end, a second distal portion proximate to a second end, and a middle portion between the first and second distal portions, wherein the first and second ends are attached to a first surface of a faceplate and the first distal portion extends perpendicularly from the first surface;

a cross brace spaced apart from the faceplate and extending between the first and second distal portions;

a first side brace attached to the cross brace and extending from the cross brace across a plane formed by the first surface to a first brace mounting end.

2. The handrail of claim 1 further comprising a second side brace attached to the cross brace and extending towards the plane formed by the first surface to a second side brace mounting end.

3. The handrail of claim 1, wherein the rail has a tubular cross section.

4. The handrail of claim 1, wherein the rail is formed from a metal.

5. The handrail of claim 1, wherein the rail is formed from wood.

6. The handrail of claim 1, wherein the rail is formed from a polymer.

7. The handrail of claim 1, wherein the faceplate is rectangular.

8. The handrail of claim 1, wherein the second distal portion extends from the first surface perpendicularly.

9. The handrail of claim 8 wherein a top surface of the first distal portion and the bottom surface of the second distal portion define a handrail height and an outer surface of the middle portion and the first surface define a handrail length perpendicular to the handrail height, and wherein the handrail height is less than about 42 inches.

10. The handrail of claim 8 wherein a top surface of the first distal portion and the bottom surface of the second distal portion define a handrail height and an outer surface of the middle portion and the first surface define a handrail length perpendicular to the handrail height, and wherein the handrail length is less than about 42 inches.

* * * * *